United States Patent [19]

Hilfiker

[11] Patent Number: 4,834,584

[45] Date of Patent: May 30, 1989

[54] DUAL SWIGGLE REINFORCEMENT SYSTEM

[76] Inventor: William K. Hilfiker, 3900 Broadway, Eureka, Calif. 95501

[21] Appl. No.: 118,317

[22] Filed: Nov. 6, 1987

[51] Int. Cl.[4] ..... E02D 5/00; E02D 5/20

[52] U.S. Cl. ..... 405/262; 405/258; 405/284

[58] Field of Search ..... 405/262, 258, 284, 285, 405/286, 287; 403/341; 52/712

[56] References Cited

U.S. PATENT DOCUMENTS

| | | | |
|---|---|---|---|
| 577,002 | 2/1897 | Blodgett | 52/712 |
| 1,762,343 | 6/1930 | Munster | 405/262 |
| 2,405,289 | 8/1946 | Cardwell | 405/262 |
| 3,421,326 | 1/1969 | Vidal . | |
| 3,686,873 | 8/1972 | Vidal | 405/262 |
| 3,922,864 | 12/1975 | Hilfiker | 405/262 |
| 3,925,994 | 12/1975 | Broms . | |
| 4,051,570 | 10/1977 | Hilfiker | 14/26 |
| 4,068,482 | 1/1978 | Hilfiker | 405/284 |
| 4,116,010 | 9/1978 | Vidal | 405/262 |
| 4,117,686 | 10/1978 | Hilfiker | 405/284 |
| 4,154,554 | 5/1979 | Hilfiker | 405/273 |
| 4,260,296 | 4/1981 | Hilfiker | 405/284 |
| 4,266,890 | 5/1981 | Hilfiker | 405/262 |
| 4,324,508 | 4/1982 | Hilfiker et al. | 405/284 |
| 4,329,089 | 5/1982 | Hilfiker et al. | 405/262 |
| 4,343,572 | 8/1982 | Hilfiker | 405/284 |
| 4,369,004 | 1/1983 | Weatherby | 405/262 |
| 4,391,557 | 7/1983 | Hilfiker et al. | 405/287 |
| 4,407,611 | 10/1983 | Murray et al. | 405/284 |
| 4,514,113 | 4/1985 | Neumann | 405/262 X |
| 4,661,023 | 4/1987 | Hilfiker | 405/262 |

FOREIGN PATENT DOCUMENTS

| | | | |
|---|---|---|---|
| 1101838 | 1/1968 | United Kingdom | 403/341 |
| 2014222 | 8/1979 | United Kingdom . | |

OTHER PUBLICATIONS

"Reinforcement of constructed Earth", pp. 98–120 and Performance of a 50-Foot High Welded Wire Wall, pp. 280–308, *Soil Improvement–A Ten Year Update*, Ed. Joseph P. Welsh, ACSE Geotechnical Special Publication No. 12 (1987).

*Primary Examiner*—Dennis L. Taylor

*Attorney, Agent, or Firm*—Limbach, Limbach & Sutton

[57] ABSTRACT

The invention provides a method and components for producing an improved reinforced soil embankment wall. In particular, the invention provides mechanical soil reinforcements having a substantially straight center portion and a frictional bearing structure on both ends. This structure minimizes the lateral force exerted on the connection between the facing wall and the reinforcement by the downward force of the settling earth on the reinforcement by providing a straight portion for passing substantially through the zone of maximum force. Frictional reinforcement and anchoring is obtained by using a frictional bearing structure on each end of the reinforcement to reinforce the outer zones within a reinforced soil enbankment wall. Pressure on the facing wall can be further relieved either by using a sinusoidal frictional bearing structure or by connecting the reinforcement to the facing wall using a connector which can stretch or otherwise relieve tension.

The invention also provides improved facing wall panels and connecting means for attaching mechanical soil reinforcements to facing walls.

19 Claims, 3 Drawing Sheets

W
F
16
4
4'
24
2
2'
14
18
$S_N$
$S_3$
$S_2$
$S_1$
26
A
22
20
$S_1'$
$S_2'$
$S_3'$
$S_N'$
28
$Z_1$
$Z_2$
$Z_3$
$L_1$
$L_2$
$L_3$
$L_4$
$L_5$
$L_6$
$L_7$
$L_8$
$L_9$
$L_{10}$
$L_{11}$
$S_1, S_2 \ldots S_N$
$S_1', S_2' \ldots S_N'$

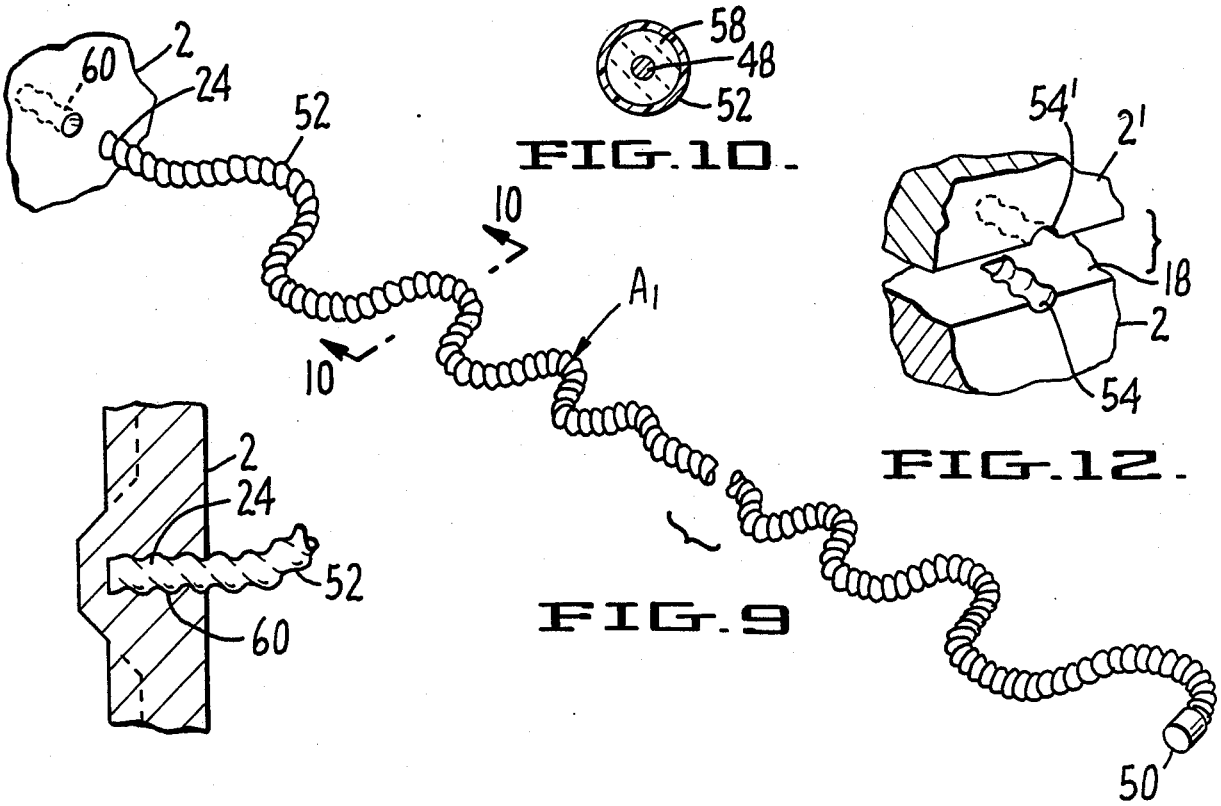
FIG. 9
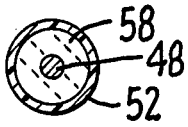
FIG. 10.
FIG. 12.
FIG. 11.
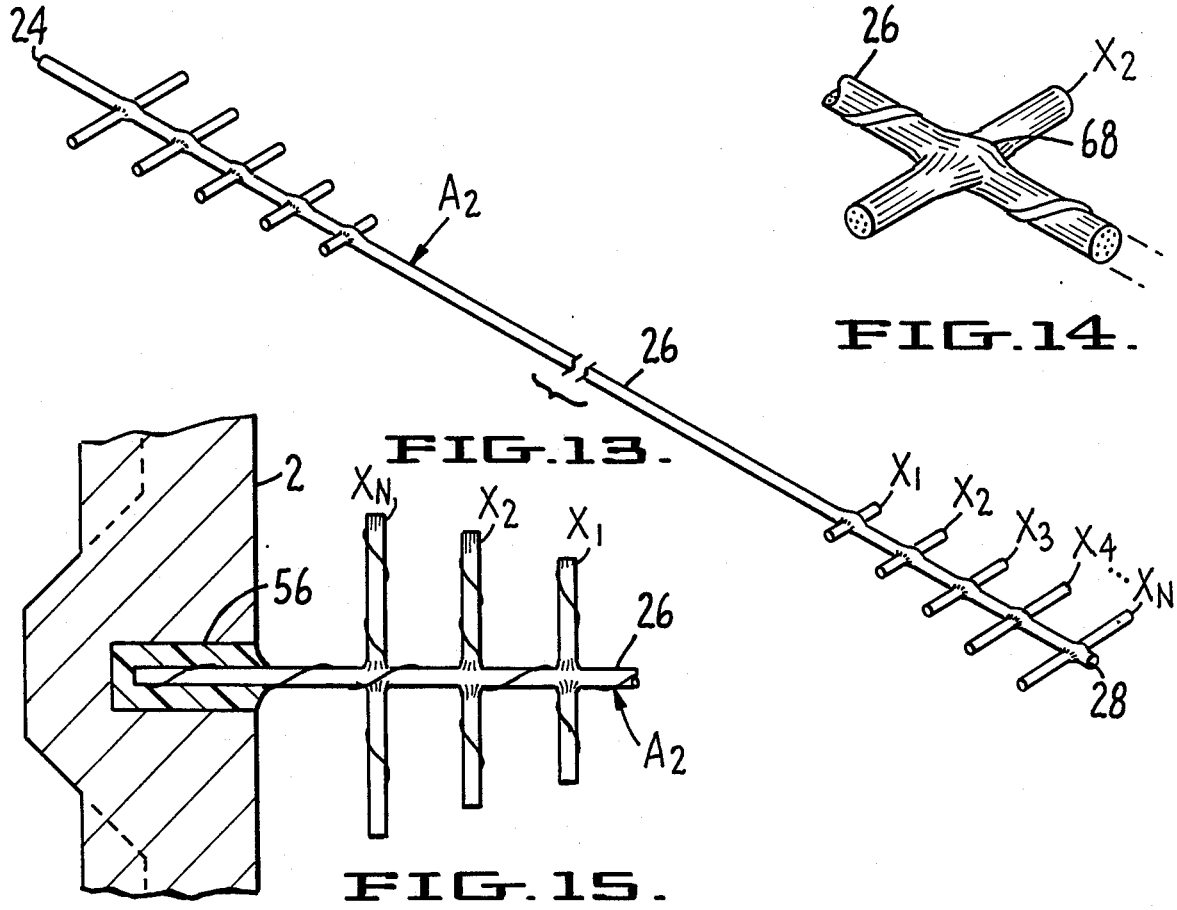
FIG. 13.
FIG. 14.
FIG. 15.

DUAL SWIGGLE REINFORCEMENT SYSTEM

TECHNICAL FIELD

The present invention relates to retaining walls. More specifically, the present invention relates to means for constructing reinforced soil embankment walls.

BACKGROUND OF THE INVENTION

Retaining walls can be constructed in a variety of ways. Cantilever walls are generally constructed as a massive, unitary "L" shaped wall, with the retained earth behind the "L" supported by the wall, and the foot of the "L" bearing the pressure exerted against the face of the wall by the earth stacked behind the "L". Because of their massive, unitary nature, these walls are generally constructed on-site using reinforced concrete, are costly, and allow the build-up of pressure behind the wall as the earth settles.

Some of the cost and mass of a cantilever wall can be reduced by eliminating the foot of the "L" and anchoring the wall to the rear of the formation as shown in U.S. Pat. Nos. 4,407,611 and 4,154,554. However, these "tie-back" retaining walls may be undesirable because, like the cantilever retaining walls, much of the weight of the soil behind the wall is borne by the face of the wall. If the anchor to the deadman is cut or breaks, the wall could be pushed over causing the earth behind it to collapse.

In contrast, reinforced soil embankment walls use means to reinforce the earth in layers. This makes the mass of earth a cohesive structure since the frontal zone of the retained formation is reinforced by its own weight against mechanical soil reinforcements, such as wire mats, spaced horizontally throughout the formation, and anchored to the more stable rear portion of the formation. Because the earthen formation is reinforced against itself, a massive retaining wall is unnecessary, and a relatively light weight, primarily decorative wall can be used to cover the face of the formation to prevent erosion. Such a facing wall is typically connected to the mechanical soil reinforcements, and may be constructed using prefabricated, interlocking facing wall panels.

Prior art mechanical soil reinforcements have included wire mats and flat metal strips which are attached to the wall and extend back horizontally into the earthen formation as shown in U.S. Pat. Nos. 4,117,686 and 4,116,010. However, such reinforcements typically are constructed from metal, have a large surface area exposed to the soil and are subject to destructive corrosion. Further, such reinforcements, because of their large exposed surface area, are forced downward during soil compaction and later by the weight of the settling earth, creating tension in the connections to the rigid facing wall or facing panels to which the soil reinforcements have been attached.

Generally, such a wall will be constructed by placing the first row of wall panels, filling in a layer of compacted earth behind the panels, placing soil reinforcements on top of the layer of compacted earth and attaching them to the wall. Then the next course of the wall is built by placing another row of wall panels atop the first row of wall panels, and adding another layer of compacted earth on top of the reinforcements. The process is then repeated until the wall is finished.

During and following construction, the wall is subjected to internal stresses due to compression from settling of the layers. The amount of compression from settling depends upon the amount of compaction during construction, the height of the finished wall, and the amount of overburden pressure. Because the rigid concrete facing panels do not settle as the earth layers settle, the connections between the soil reinforcements and the facing panels are stressed as the reinforcements are forced downward by the settling soil. This stress has caused wall failures when the earth layers are poorly compacted during construction and when the wall is subjected to external stresses, for example, earthquakes.

To prevent such destructive loading, the lateral forces on the wall from the front of the formation have been relieved by relaxing somewhat the attachment of the reinforcements to the wall, for example, as shown in U.S. Pat. No. 4,343,572.

Thus, the need exists for a means for reinforcing a soil reinforced embankment wall using reinforcements which frictionally reinforce the layers of earth effectively but which are designed to reduce stress on the connections between the facing panels and the reinforcements.

SUMMARY OF THE INVENTION

The present invention provides a method and components for a reinforced soil embankment wall in which the structure is reinforced frictionally using reinforcements which frictionally reinforce the formation at the ends of the formation but which do not provide substantial frictional reinforcement in the center of the formation, producing a stable, cohesive reinforced soil embankment wall with a minimum of lateral force transferred to the wall facing.

In one embodiment, the present invention provides a reinforced soil embankment wall in which the facing wall is connected to mechanical soil reinforcements having an elongated straight center portion and a frictional bearing structure on both ends, which are placed in layers throughout the earthen formation to reinforce it. The frictional bearing structures of the mechanical soil reinforcements frictionally reinforce the front and back of the formation and anchor the wall to the back of the formation. The structures take the form of multiple generally horizontally disposed legs extending laterally relative to either side of the longitudinal axis of the center portion of the reinforcements. In one exemplification, the legs comprise planar sinusoidal curves which progressively increase in size from the straight center portion toward both ends of the reinforcement. In another the legs comprise cross pieces which increase in size from the straight center portion to each end, or any other similar structure capable of frictionally reinforcing the soil at the ends of the earth formation.

In another embodiment, the present invention provides soil reinforcements having an elongated straight center portion and a frictional bearing structure at each end (hereinafter referred to as a dual swiggle reinforcement). The frictional bearing structures frictionally reinforce the front and rear of the formation and anchor the wall to the rear of the formation. These frictional bearing structures may take the form of planar sinusoidal curves at each end which progressively increase in size from the straight center portion to the end of the reinforcement. Alternatively, the frictional bearing structure may take the form of cross pieces attached to the ends of a straight member, such as a length of fiberglass rod or rebar, or take any other form which will provide a frictional bearing surface. Either one or both ends of the reinforcement may be adapted to connect to a facing wall.

In yet another embodiment, the present invention provides facing wall panels incorporating an embedded rod for connecting mechanical soil reinforcements.

In yet another embodiment, the present invention provides a rapid means for connecting mechanical soil reinforcements to facing wall panels having embedded rods adapted to mate with either end of an reinforcement.

In yet another embodiment, the present invention provides a method for constructing an improved reinforced soil embankment wall.

BRIEF DESCRIPTION OF THE DRAWINGS

A better understanding of the invention and its advantages will be apparent from the detailed description taken in conjunction with the accompanying drawings in which:

FIG. 9 is a perspective view of an alternative dual swiggle reinforcement;

FIG. 10 is a cross-sectional view of the alternative dual swiggle reinforcement of FIG. 9 taken along line 10—10 of FIG. 9;

FIG. 11 is an enlarged top plan cross-sectional view of a threaded socket connecting means formed within a wall face panel and adapted to cooperate with the end of the dual swiggle reinforcement shown in FIG. 9;

FIG. 12 is a perspective cross-sectional view of the connecting means of FIG. 11 in which one-half of the threaded socket is preformed on the stacking surfaces of said face panels;

FIG. 13 is a perspective view of another alternative dual swiggle reinforcement;

FIG. 14 is an enlarged perspective cross-sectional sectional view taken at the intersection with one transverse bar of the dual swiggle reinforcement of FIG. 13;

FIG. 15 is an enlarged top plan cross-sectional view showing the dual swiggle reinforcement of FIG. 13 attached to a preformed socket in a facing wall panel.

DETAILED DESCRIPTION

Figures 1, 2, 3:
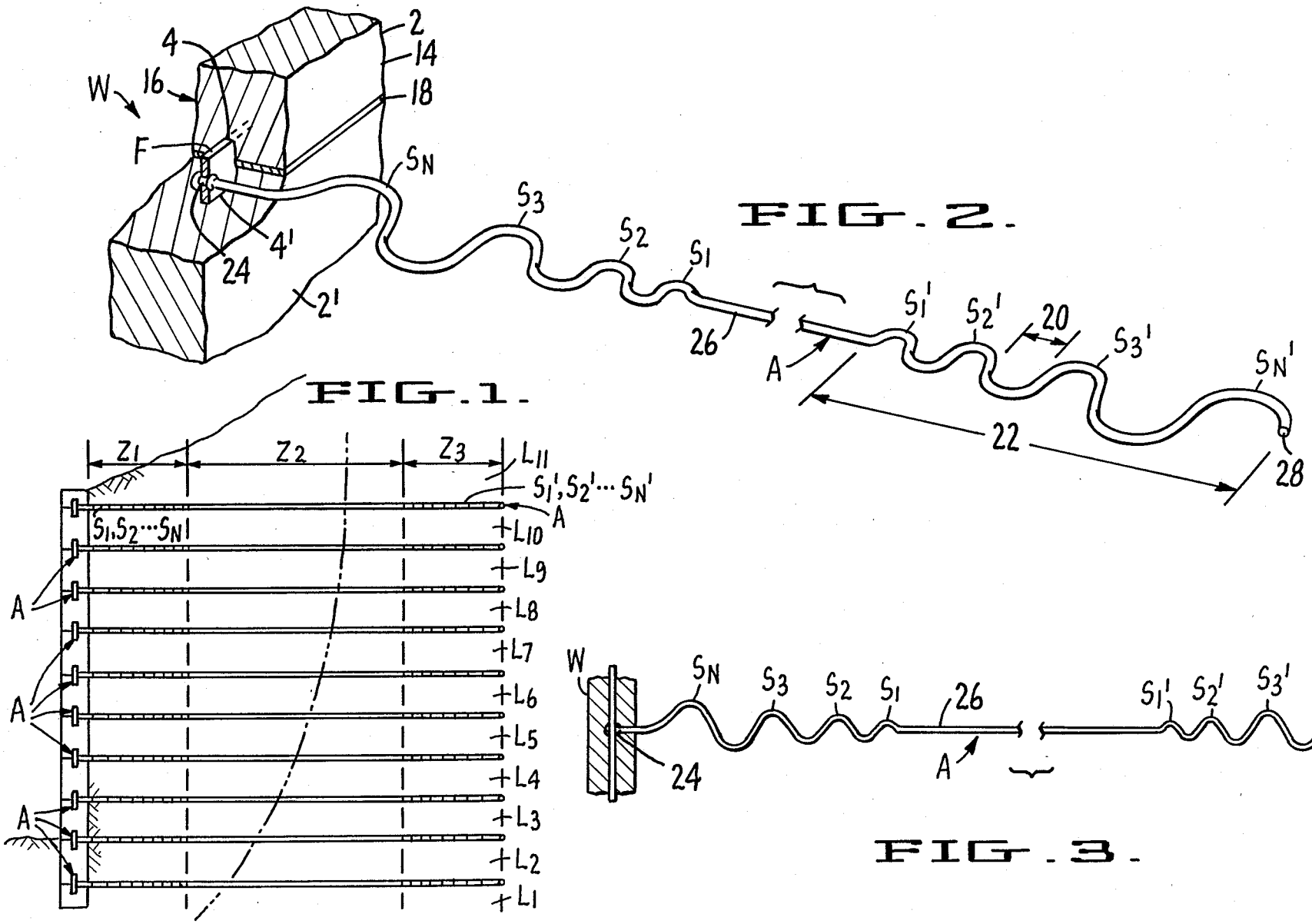
FIG. 1 is an elevational cross-sectional view of an earthen wall comprising a wall face and backfill showing the three zones, including the zone of maximum force within said wall.
FIG. 2 is a perspective cross-sectional view showing a dual swiggle reinforcement attached to a flat connector bar received between vertically stacked facing wall panels.
FIG. 3 is a top plan cross-sectional view showing a dual swiggle reinforcement attached to a facing wall panel using a flat connector bar received between vertically stacked facing wall panels.

FIG. 1 illustrates the need for the present invention. There are three distinct zones in a reinforced soil embankment wall. $Z_1$ is the front of the formation, in which the force of compression caused by the settling of the earthen layers is expressed as a lateral force against the facing wall. This zone extends from the back of the facing wall from about one foot to about five feet into the formation, with about three feet being typical for sandy soil backfill.

$Z_2$, located at the center of the formation, is called the zone of maximum force. In $Z_2$, the vertical compression caused by the settling of the earthen layers is greatest. Maximum compressive force is found along the plane represented by the broken line P which is contained within $Z_2$. $Z_2$ can be determined in many ways by one skilled in the art. For example, $Z_2$ can be determined by referring to force distribution charts for similar soil types. For example, such a chart for sandy backfill appears in FIG. 22 of "Welded Wire Wall Performance", *Soil Improvement—A Ten Year Update,* Joseph P. Welsh, Editor, American Society of Civil Engineers Geotechnical Special Publication No. 12 (1987), in which zone 2 begins at about 3 feet from the back surface of the facing wall and extends back to about 25 feet into the formation. While the actual location of $Z_2$ will vary depending on the distance from the reinforcement to the top of the wall, $Z_2$ is preferably calculated to include all the maximum forces for the entire wall.

$Z_3$ is the rear of the formation into which reinforcements are embedded to support and hold upright the facing wall. This zone is an area of "pullout resistance" in which the overburden exerts sufficient pressure against the frictional bearing surface of the reinforcements to securely anchor the reinforcements and the attached facing wall to the rear of the formation. $Z_3$ exists behind the failure plane for the reinforced wall.

$Z_1$ requires frictional reinforcements to stabilize and reinforce the layers of earth $L_1$ through $L_{1l}$ behind the facing wall. $Z_3$ requires frictional reinforcements to stabilize and reinforce the earth and to anchor the facing wall to the back of the formation. However, if frictional reinforcements are also used in $Z_2$, they will tend to be compressed downward by the force of the settling earth and will increase the pressure on the connections between the reinforcements A and the facing wall W. This effect is minimized by the present invention which uses a dual swiggle mechanical soil reinforcement A having a straight center 26 through $Z_2$, a frictional bearing structure ($S_1$, $S_2$ . . . $S_n$) for reinforcing the front of the formation in $Z_1$, and a frictional bearing structure ($S_1'$, $S_2'$ . . . $S_n'$) for anchoring reinforcement A and facing wall W and reinforcing $Z_3$. The straight center portion 26 is resistant to longitudinal stretching and, because of the minimum surface area, minimally impedes the settling of the soil.

FIGS. 2 and 3 illustrate a dual swiggle reinforcement of the present invention. The dual swiggle reinforcement A is comprised of a connecting end 24, a series of sinusoidal curves designated as $S_1$, $S_2$, $S_3$, and $S_n$, an elongated straight center portion 26, another series of sinusoidal curves designated as $S_1'$, $S_2'$, $S_3'$, and $S_n'$, and a free end 28.

The straight center portion 26 is intended to pass through $Z_2$. Although the straight center portion 26 may vary in size from one reinforcement to another depending upon vertical location in the wall, preferably all reinforcements used in a wall will have identical dimensions due to the cost savings obtained by mass production.

As may be seen from FIGS. 2 or 3, the length of the swiggles preferably increase incrementally from the center 26 to the ends 24 and 28. Thus, $S_n$ is larger than $S_3$, $S_3$ is larger than $S_2$, and $S_2$ is larger than $S_1$. The swiggles $S_1$–$S_n$ are of planar configuration and oriented in a horizontal disposition within an earthen formation. This sinusoidal frictional bearing structure on either end of straight center section 26 both provides frictional reinforcement and allows some stretch to provide additional relief for interformational pressure. By increasing the size of the sinusoidal curves from the center portion to the ends, not only is an effective frictional bearing surface obtained, but uniform stretch over the length of the sinusoidal curves is obtained because the smallest curve $S_1$, located closest to the center portion 26 of the reinforcement, is more resistant to stretching than the larger curves located toward the ends of the reinforcement. This provides both an effective frictional bearing structure for reinforcing the soil at the ends of the formation and a structure which can "give" or stretch uniformly at the ends to relieve pressure on the facing wall.

The reinforcing dual swiggle reinforcement A may be fabricated of rebar stock or any other suitable rod-type material and may vary in dimension depending upon the depth and composition of the earthen formation to be reinforced. Increased reinforcement may be provided by increasing the width, the length, and/or the number of swiggles at the ends of the bar. Utilization of rebar for fabrication of the reinforcement A has the advantage of being readily available, inexpensive, easily bent to provide the frictional bearing surface, and resistant to corrosion because the circular section of the bar minimizes the surface area exposed to the earth in the formation, thereby resulting in a longer functional life in comparison to use of other prior art reinforcements having cross sections exposing large surface area to the earth, such as flat metal strip reinforcements. Other materials can also be used, such as fiber impregnated structural resin rods, or other metal rods less resistant to corrosion than steel.

In the preferred embodiment, the diameter range of the rod used to construct the dual swiggle reinforcement ranges from about ½" to about ¾", with the larger diameters used at the bottom of the wall where the forces are greater due to the greater overburden. This range has the advantage of avoiding short functional life caused by corrosion while withstanding the extreme force exerted by the surrounding earth.

The length 22 of the sinusoidal curved section can vary from about 1 foot to about 5 feet. Although the length 22 of the sinusoidal curve at the connector end 24 may be different from the length of the sinusoidal curve at the free end 28, the sinusoidal curves will preferably have the same dimensions at both ends. Thus, for sandy soil backfill, length 22 will preferably be about 3 feet. The total length of reinforcement A will preferably be equivalent to about 7/10 of the constructed wall height.

The dual swiggle reinforcement of the preferred embodiment in the present invention has the advantage of providing greater traction (frictional bearing surface) against the earthen surface than that provided by reinforcing bars of straight configuration. Generally, the larger the sinusoidal curve, and the closer $S_1 \ldots S_n$ are to each other, the greater the traction. Preferably, the distance 20 between the sinusoidal curves will be about 4 inches.

This swiggle configuration also provides a means for relaxing somewhat the reinforcement attachment to the facing wall when the earth fill within which reinforcements A are embedded settles, thus relieving increased pressure on facing wall W. The greatest stretch lies in the largest sinusoidal curves. Further, by incrementally increasing the size of the sinusoidal curves from the straight center portion towards the ends, uniform stretch over the entire frictional bearing structure is provided.

Dual swiggle reinforcements A can be connected to a facing wall W in a variety of ways. For this purpose, one or both ends of a dual swiggle reinforcement A may be adapted to cooperate with the particular fastening system used. FIG. 2 illustrates a dual swiggle reinforcement A of the present invention connected to a flat connector bar F, received between stacked face panels 2, 2'. Connector bar F runs parallel to the back surface 14 and front surface 16 of panels 2, 2' and is held at the interface 18 between panels 2, 2' in slot 4 of panel 2 and slot 4' of panel 2'. Holes are bored at spaced intervals on connector F through which the connecting ends 24 of the dual swiggle reinforcement A are inserted and attached, for example, by riveting, bolting or using any other fastening means adapted to cooperate with end 24. The flat connector bars F are generally composed of strong materials, like steel and iron, which are capable of withstanding extreme force and substantially resisting corrosion.

Figure 4:
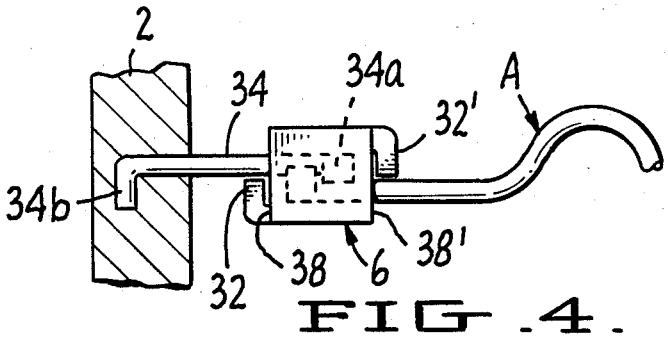
FIG. 4 is an enlarged plan view of a connecting means for attaching a dual swiggle reinforcement to a facing wall panel having an embedded rod adapted to cooperate with an end of the dual swiggle reinforcement.
Figure 5:
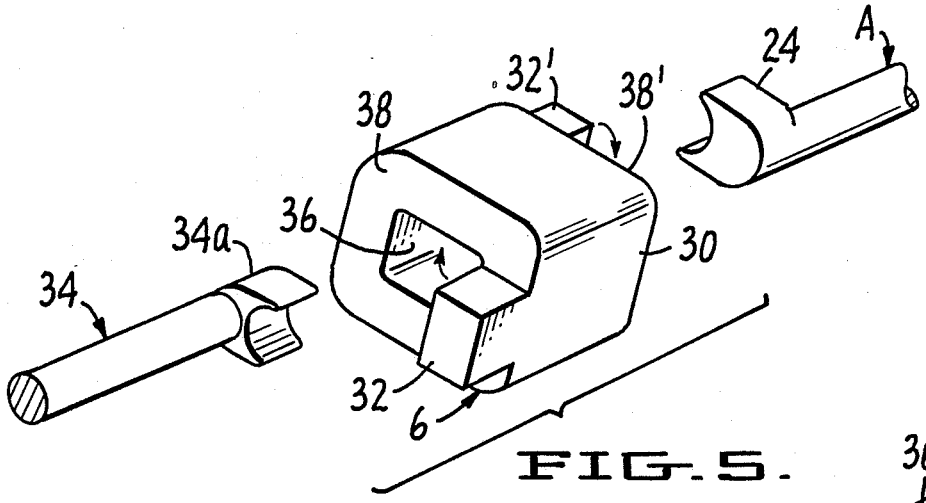
FIG. 5 is an exploded perspective view of the connector of FIG. 4 before the embedded rod and the end of the dual swiggle reinforcement are cooperatively engaged.
Figure 6:
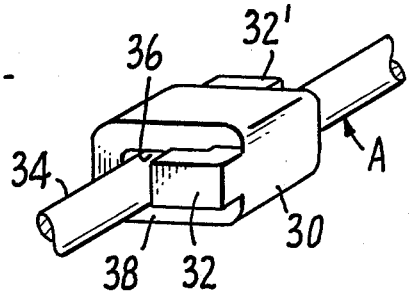
FIG. 6 is a perspective view of the connector of FIG. 4 showing the connector tabs bent to secure the connector in place over the engaged ends of the embedded rod and the dual swiggle reinforcement.

FIGS. 4–6 illustrate another preferred means of attaching the dual swiggle reinforcement A of the present invention to a facing wall. This attaching means will automatically orient and maintain the reinforcement in a horizontal position in the formation. Rather than connecting to a plate held at the interface between interlocking facing wall panels, this embodiment uses a facing wall panel 2 having embedded within it an anchor 34 which may be fabricated with the same rebar stock preferably used for the dual swiggle reinforcement A. One end **34*b* is adapted to be embedded in panel 2. For example, 34*b* may be bent perpendicular to reinforcement rod 34 and then embedded in the facing wall panel. The other end 34*a* extends from the back surface of panel 2 and is adapted to interlock with a compatible connecting end 24 of dual swiggle reinforcement A to orient and hold reinforcement A in a horizontal orientation in the formation. Thus, when anchor 34 is initially embedded in facing wall panel 2, it is oriented so that when it engages end 24 of reinforcement A in use, $S_1$ through $S_n$ will lie in a horizontal plane parallel with the layers of earth behind the facing wall. Alternatively, either end 34*a* or end 24 may be constructed to be rotatable, eliminating the need to specifically orient anchor 34 in panel 2**.

The connector 6 is comprised of a collar 30 fabricated of any strong compatible material, such as steel, and is shown as having a generally elongated square outer configuration with a passageway 36 of a size large enough to slidingly fit over and cover the interlocked cooperating ends 34*a* and 24, yet small enough to prevent the disengagement of those ends when the collar is placed over them. The outer configuration of connector 6 may be varied as desired to improve manipulation by assemblers. The connector collar 30 is then locked in position over engaged ends 34*a* and 24 by bending down tabs 32 and 32' which close off a portion of passageway 36 at each end 38, 38' to prevent collar 30 from being slidingly removed.

The connection between connecting end 24 of reinforcement A and end 34*a* of anchor 34 is made by first sliding collar 30 over the ends of either reinforcement A or bar 34 before engaging ends 34*a* and 24. Once the connecting ends 34*a* and 24 are interlocked, the collar 30 is slidingly moved over the engaged ends 34*a* and 24 and the bendable tabs 32, 32' disposed at the opposing openings 38, 38' are bent in towards openings 38, 38' thereby locking collar 30 in position over the engaged ends 34*a* and 24, locking reinforcement A and anchor 34 together. In this position, $S_1$–$S_n$ are oriented in a planar horizontal disposition within the earthen formation.

Figure 7:
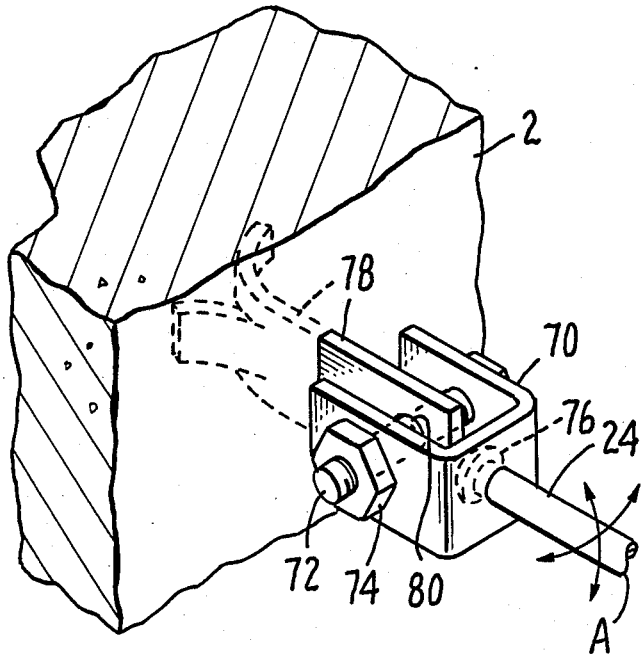
FIG. 7 is a perspective view of an alternative connector means for attaching a dual swiggle reinforcement to a facing wall panel having an embedded anchor with a protruding end adapted to receive the connector means.
Figure 8:
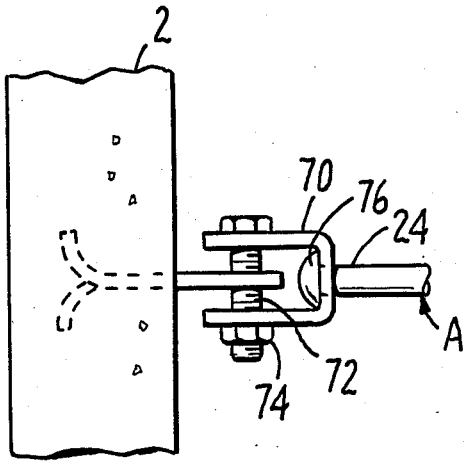
FIG. 8 is a top plan view of the connector means of FIG. 7.

FIGS. 7–8 illustrate an alternative means of attaching reinforcement A to a facing wall. In this embodiment, facing wall panels 2 are used which have embedded within them anchors 78, one end of which protrudes from the back surface of panel 2 and is adapted to receive the modified connector end 24 of reinforcement A, for example, by drilling a hole 80 through the protruding end of anchor 78. The connecting end 24 of each reinforcement A is adapted by attaching a clevis 70 using a rivet 76 or other suitable means. The clevis 70 is then attached to the protruding end of anchor 78 by passing a bolt 72 through the clevis 70 and the hole 80 in anchor 78 and securing bolt 72 in position by tightening nut 74. The primary advantage of this type of connection derives from the ability of the clevis 70 to rotate about bolt 72 relative to the embedded anchor 78. Thus, if reinforcement A is forced downward somewhat by settling earth during or after construction of the reinforced soil embankment wall, the attached clevis can rotate downward, avoiding potential stress at the connection.

The construction of a reinforced soil embankment wall according to the present invention can be illustrated by reference to FIG. 1. Construction begins with placement of a first course of panels 2. Earth is then filled in behind the panels and compacted to the level where the reinforcements are to be placed. Dual swiggle reinforcements A are engaged with the first course of panels in a horizontal planar configuration on top of the first layer of compacted earth fill. Resilient pads 18 may be placed on the top surface 10 of the wall panels 2 of the first course, and the next course of panels 2' are placed on top of the first course and interlocked. Earth is filled in behind the next course of panels 2' and compacted on top of the first layer and reinforcements A, and the process is repeated until the wall is complete.

The dual swiggle reinforcement A of the present invention may take many forms, the basic concept being that of a straight center portion for emplacement in zone $Z_2$ and frictional bearing structures on the ends for reinforcing and anchoring zones $Z_1$ and $Z_3$. FIGS. 15 through 21 illustrate possible alternative dual swiggle reinforcements.

FIGS. 9–12 illustrate a dual swiggle reinforcement having sinusoidal curves as previously described above. This dual swiggle reinforcement, designated $A_1$, may also be constructed from rebar or other suitable metal rod 48, but is further protected from corrosion by being placed within plastic tubing 52. This tubing 52 most preferably is a polymer corrugated in appearance, being flexible and durable and having an external spiral configuration. The rod 48 may be sealed within tubing 52 using sealant 58 which can be cement grout or any other suitable sealant.

If the reinforcement rod 48 is sealed inside tubing 52, the now spiral connecting end 24 may be used to attach the reinforcement $A_1$ to the facing wall W. One way of doing this, shown in FIG. 17, requires a cooperating threaded insert or cavity 60 be embedded in panel 2. To make the attachment, the connecting end 24 of reinforcement $A_1$ is simply screwed into threaded cavity 60 in panel 2. While horizontal orientation of reinforcement $A_1$ is not automatically obtained, reinforcement $A_1$ can be rotated in threaded cavity 60 to be tightened or loosened in order to obtain horizontal orientation on top of a layer of earth fill.

Another way of using the spiral connecting end 24 of reinforcement $A_1$ to attach the reinforcement to the facing panel 2, shown in FIG. 18, is similar except that half 54 of threaded cavity 60 for receiving end 24 is located at the top of a panel 2 and the other half 54' is located at the bottom of a panel 2', such that when the panels are stacked and interlocked the threaded cavity 60 is formed at the interface 18 between panels 2 and 2'.

The free end 28 of dual swiggle reinforcement $A_1$ should be sealed with a plastic cap 50 to prevent internal corrosion caused by moisture when rod 48 is encased in plastic tubing as shown in FIGS. 15 through 18.

FIGS. 13 to 15 show an alternate dual swiggle reinforcement, designated $A_2$, constructed by attaching a series of transverse bars $X_1$–$X_n$, to each end of a straight rod, providing a substantially straight center portion 26, a free end 28, and a connecting end 24. As with the sinusoidal curves $S_1$–$S_n$ previously described, transverse bars $X_1$–$X_n$ may get progressively shorter as they approach the elongated center portion 26. Thus, $X_n$ may be larger than $X_{n-1}$ just as $X_2$ may be larger than $X_1$. However, it is not essential that the length of each transverse bar be progressively shorter as the center portion 26 is approached, since this frictional bearing structure does not have the innate ability to "stretch" which is found with the sinusoidal curve frictional bearing structure. Because there is no need to provide for a uniform stretch to preserve a frictional bearing surface, there is no need for $X_1$ to be the smallest transverse bar. However, by generally providing for increased size of the transverse bars toward the ends, one may minimize the effect of the settling earth on the reinforcement A2 and the lateral pressure on the connection between reinforcement A2 and wall W by providing increasing frictional reinforcement of the soil toward the front and back of the formation.

Like the preferred sinusoidal curve configuration the transverse bars $X_1$–$X_n$ have the advantage of providing greater traction against the earthen surface than that generally provided by reinforcing rods of straight configuration. The transverse bars $X_1$–$X_n$ are arranged in a planar configuration and oriented in a horizontal disposition within the earthen formation to be reinforced. However, because the transverse bar configuration does not have the innate ability to stretch at the ends to relieve pressure which may be exerted on the facing wall by settling of the earthen formation, they may be attached to wall W using a means having an ability to stretch, such as that shown in U.S. Pat. No. 4,343,572, if such stretch is desired.

The dual swiggle reinforcement $A_2$ with transverse bars may be fabricated of any suitable material, but is particularly suited to construction from fiber reinforced resin rods and may vary in dimension depending upon the depth and composition of the earthen formation to be reinforced. Increased reinforcement may be provided by increasing the width, length, and/or the number of transverse bars at the ends of the reinforcement. Utilization of fiber reinforced resin rod for fabrication of the dual swiggle reinforcement with transverse bars is preferred for being several times stronger than steel rebar, giving this embodiment of the invention the ability to withstand a greater amount of downward stress and for making the dual swiggle reinforcement non-corrosible. Further, by constructing the dual swiggle reinforcement $A_2$ with transverse rods from fiber reinforced resin, it is possible to mold the entire reinforcement as a unitary piece. As shown in FIG. 18, the main rod is formed by bundling several fiberglass strands into the desired diameter, preferably ½" to ¾". The fiberglass strands are initially held together by a plastic cord, or similar material. At each point 68, wherein a transverse bar is placed, the fiberglass strands are pulled apart and the respective transverse bar $X_1$, $X_2$, . . . or $X_n$ is inserted therebetween. The dual swiggle reinforcement $A_2$ with transverse rods is then treated with an epoxy, or like material, to fuse the material together to form a unitary reinforcement.

Such a dual swiggle reinforcement $A_2$ with transverse rods could be connected to a facing wall using any of the connecting methods and means described above, assuming that the connecting end of the reinforcement is suitably adapted to be used with the desired connection method. However, yet another connection method is available when fastening fiber reinforced resin rods to facing walls.

As shown in FIG. 15, if a socket 56 is provided in panel 2, the attachment can be made by inserting the connecting end 24 of the fiber reinforced dual swiggle reinforcement $A_2$ with transverse rods into socket 56 and filling socket 74 with epoxy and curing, forming plug 58.

Although the present invention has been discussed in the preferred embodiments in which one end of the reinforcements is attached to a wall W and the other end of the reinforcements is anchored in the rear portion of the earthen formation, it is also possible to adapt the dual swiggle reinforcements to anchor two facing walls together while reinforcing the earth in between them. In this type of structure, the reinforcement is placed on top of a layer of compacted earth captured between two facing walls and is attached at one end to one facing wall and at the other end to the second facing wall. Another layer of earth is placed between the walls and compacted, and the process continued until the wall is completed.

The invention will be further understood from a consideration of the following example. It should be understood, however, that this example is merely an illustration and is not intended in any way to limit the scope of the claims.

EXAMPLE 1

To construct a fifty foot high reinforced soil retaining wall, constructed using sandy soil backfill compacted during construction, the following should produce satisfactory results:

Each layer of reinforced soil wall will require one dual swiggle reinforcement attached to the facing wall every 3 feet horizontally for the full width of the facing wall. Each reinforcement should have a 5 foot long sinusoidal curved section on each end (measured perpendicularly to the transverse curved sections from the end of the straight center portion out to each end), and a straight center portion 29 feet long. Thus, the full length of the reinforcement should be about 0.7 times the height of the wall or about 35 feet long. The distance between the transverse sinusoidal curves should be about 4 inches. The reinforcements should be constructed from steel rebar. The diameter of the rebar used to construct the reinforcements should be ¾ inch for the bottom 40 feet of the wall and ½ inch for the top 10 feet of the wall.

Following excavation and construction of a proper foundation for the facing wall, the first layer of backfill is placed behind the first tier of the facing wall and compacted. The dual swiggle reinforcements are placed horizontally on the compacted backfill every 3 feet and attached to the wall. The facing wall is then built up another 2 feet and backfill is placed behind the wall and compacted, and the process is repeated. Thus, a layer of reinforcements will be placed in the wall for every 2 feet of height.

One skilled in the art will recognize at once that it would be possible to construct the present invention from a variety of materials and to modify the processes described herein in a variety of ways. For example, the frictional bearing structure of the dual swiggle reinforcement can take a variety of forms other than those disclosed herein. While the preferred embodiments have been described in detail, and shown in the accompanying drawings, it will be evident that various further modifications are possible without departing from the scope of the invention as embodied in the claims.

I claim:

1. An improved reinforced soil embankment comprising:

a. a wall at the face of the embankment;

b. earth fill disposed behind said wall, said fill having a first zone adjacent said wall, a third zone spaced from said first zone, and a second zone of maximum force disposed intermediate said first and third zones; and, c. a plurality of generally horizontally disposed mechanical soil reinforcements attached to said wall and extending into the earth fill, each of said soil reinforcements comprising a rod having:

(1) an elongated, substantially straight center portion of a narrow horizontal cross-section having a longitudinal axis extending across said second zone; and, (2) end portions on each end of said straight portion located for embedment in said first and third zones, said end portions each having laterally extending soil gripping means of a horizontal dimension greater than the horizontal cross-section of the center portion to frictionally engage the fill in said first and third zone, said gripping means being in the form of multiple generally horizontally disposed legs extending laterally relative to either side of the longitudinal axis of the center portion.

2. An embankment according to claim 1 wherein said wall is comprised of panels.

3. An embankment according to claim 2 wherein said gripping means comprise horizontally extending sinusoidal curves formed in said end portions which increase in size from the straight center portion of the reinforcements out toward the ends of said reinforcements.

4. An embankment according to claim 2 wherein said reinforcements are metal.

5. An embankment according to claim 4 wherein said reinforcements are encased and sealed within corrosion resistant plastic tubes.

6. An embankment according to claim 2 wherein said gripping means comprises a series of transverse bars.

7. An embankment according to claim 6 wherein said reinforcements are constructed of fiber reinforced structural resin.

8. An embankment according to claim 2 further comprising connector means for releasably attaching the reinforcements to the wall.

9. An embankment according to claim 8 wherein said connector means comprise sockets within said wall for receiving the reinforcements.

10. An embankment according to claim 9 wherein said sockets are threaded.

11. An embankment according to claim 8 wherein said connector means are located at the interface between said wall panels.

12. An embankment according to claim 11 wherein said connector means comprise flat plates secured to the reinforcements and recesses formed in the interfaces between the panels for receipt of said plates.

13. An embankment according to claim 8 wherein said connector means comprise:

first anchor elements embedded within the wall panels;

second anchor elements carried by the reinforcements, said second anchor elements being engagable with said first anchor elements;

means for selectively securing said first and second anchor elements together upon engagement.

14. An embankment according to claim 13 wherein said means for securing said first and second anchor elements together comprises:

a collar having first and second ends and a passageway extending from said first end to said second end, said passageway having a size large enough to slidably fit over and contain said engaged first and second anchor elements but small enough to prevent said engaged ends from disengaging when said collar covers said engaged ends; and, a means for holding said collar in position over said engaged ends.

15. An embankment according to claim 14 wherein said means for holding said collar in position over said engaged ends comprises a first tab at said first end and a second tab at said second end, said tabs being bendable from positions which do not obstruct the passageway to positions obstructing at least a portion of the passageway to prevent said collar from being slidably removed from said engaged first and second anchor elements.

16. An embankment according to claim 13 wherein said first elements comprise clevis embedded within and extending from said panels and the second elements comprise extensions engagable with said clevis.

17. An embankment according to claim 16 wherein said means for securing said first and second anchor elements together comprises a bolt extending horizontally through the clevis and extension to permit the reinforcement to hinge around the bolt.

18. An improved method for constructing a reinforced soil embankment having within it a zone of maximum force, said method comprising the steps of:

a. constructing a wall at the face of the embankment;

b. placing earth fill behind said wall, said fill having a first zone adjacent said wall, a third zone spaced from said first zone and a second zone of maximum force disposed intermediate said first and third zones;

c. placing within said earth fill in generally horizontal planes a plurality of mechanical soil reinforcements, each said soil reinforcement having:

(1) an elongated substantially straight center portion of a narrow cross-section having a longitudinal axis extending across said second zone; and, (2) enlarged frictional bearing structure at each end disposed within and in frictional engagement with said first and third zones such that each said frictional bearing structure lies substantially outside said zone of maximum force, said enlarged frictional bearing structures each being in the form of multiple generally horizontally disposed legs extending laterally relative to either side of the longitudinally axis of the center portion;

d. compacting said earth fill;

e. attaching said reinforcements to said back surface of said wall.

19. An improved method according to claim 18 wherein said earth fill is placed and compacted behind the wall in layers and the soil reinforcements are placed between said layers.

* * * * *